US005810363A

United States Patent [19]

Saunders et al.

[11] Patent Number: 5,810,363

[45] Date of Patent: Sep. 22, 1998

[54] TARGET ASSEMBLY

[75] Inventors: Eugene Saunders; Charles Saunders, both of Columbus, Nebr.

[73] Assignee: Saunders Archery Co., Columbus, Nebr.

[21] Appl. No.: 739,791

[22] Filed: Oct. 30, 1996

[51] Int. Cl.[6] ..... F41J 1/10; A65B 63/00

[52] U.S. Cl. ..... 273/407; 473/197; 273/400

[58] Field of Search ..... 273/348, 400, 273/401, 402, 407; 473/197

[56] References Cited

U.S. PATENT DOCUMENTS 5,562,288 10/1996 Erdebaev ..... 473/197

*Primary Examiner*—Mark S. Graham
*Attorney, Agent, or Firm*—Michael G. Berkman

[57] ABSTRACT

A target assembly for use with a variety of non-piercing type projectiles or missiles launched to strike or impinge upon the target, whereupon the latter acts effectively to terminate the flight of the missile. The assembly includes a frame defined by flexible and resilient rods disposed to support a shock-sustainable, shock-resistant tensioned web or target sheet. The web itself is fabricated of a shock-sustainable, shock absorbing material, and is tensioned in a taut mode so that the propulsion energy of the missiles projected to impinge upon the web and to impact thereagainst is effectively dampened and absorbed by the target as the flight of the missile is terminated. The resilient rods which support and tension the impact web of the target are engaged in and secured, at their ends remote from the target web, in a support structure which includes a hub-like block or plate and a substrate-carried supporting stand, all set back or positioned rearwardly of the tensioned web or target sheet. The target assembly is characterized in that, constructed, oriented, and supported as described, after deformation or twisting caused by the impacting of a missile or projectile, the tensioned web resets and returns to its initial, forwardly-presented mode, to face the shooter.

5 Claims, 2 Drawing Sheets

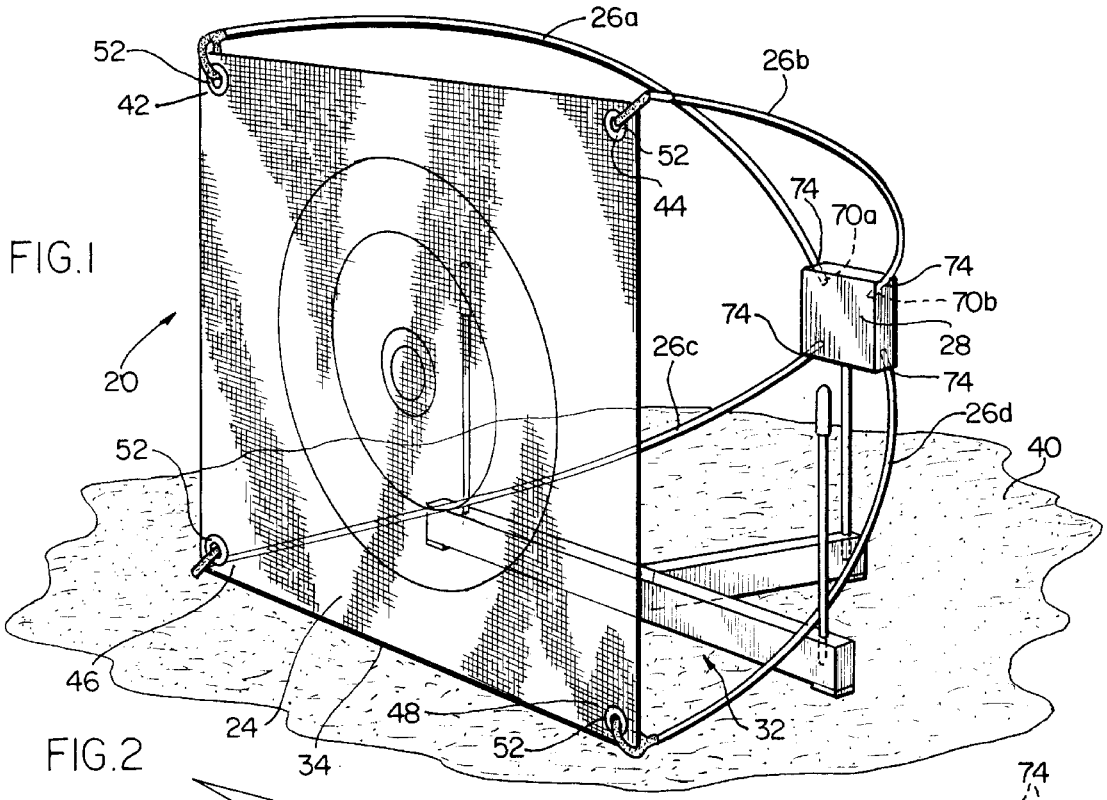
FIG.1
FIG.2
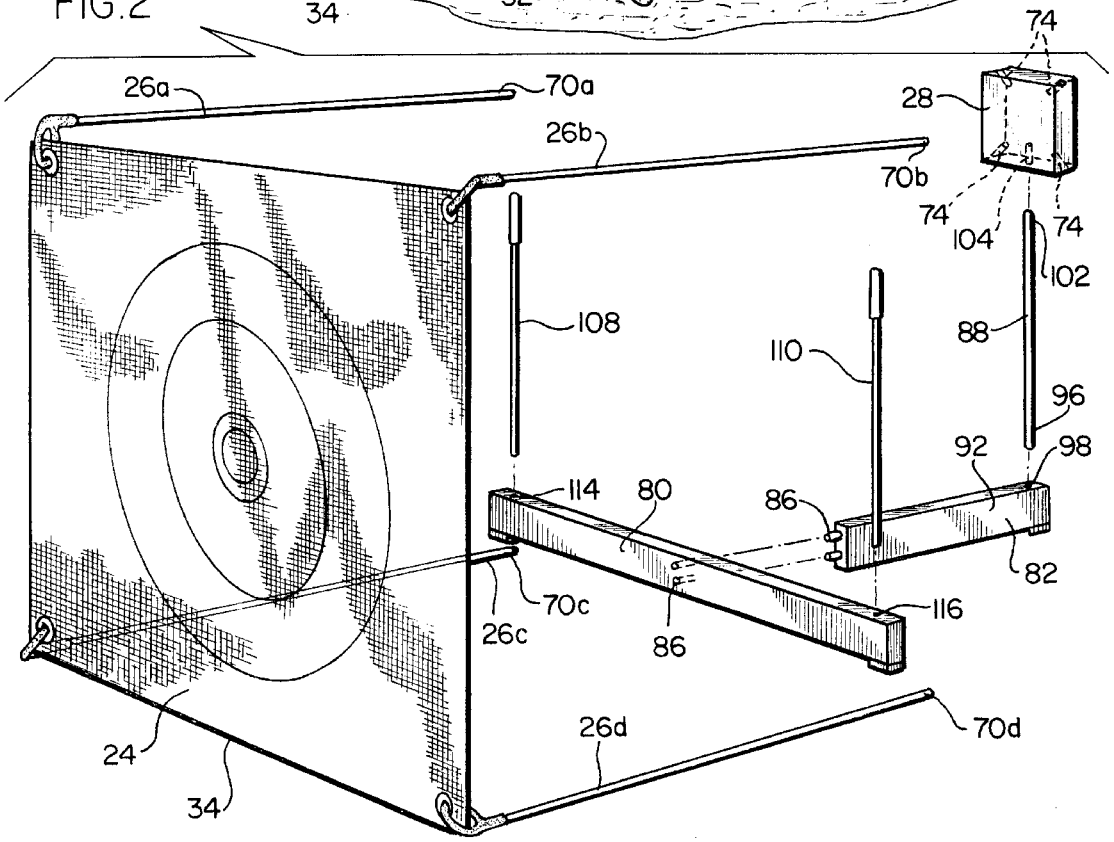

TARGET ASSEMBLY

BACKGROUND AND FIELD OF THE INVENTION

The present invention relates to a target assembly. More particularly, the invention is directed to a target assembly for use with a variety of non-piercing type as well as so-called "penetrating" type projectiles or missiles launched or shot to strike or impinge upon a target, whereupon the latter acts effectively to terminate the flight of the directed missile.

Many and varied types of targets are known in the art. Specific targets have, in their configurations, in their constructional compositions, in their markings, as well as in their means and manner of support, been specially designed for use in particular or specific sports or games. For example, the art is replete with numerous targets used solely in archery. Dart targets of various configurations and physical structures are also known. Specially designed targets are used for hand gun practice and competition. Others are specially adapted for rifle ranges. Still other targets are specially structured and surfaced so as to provide an impact surface or face to which a missile carrying a suction-type dish at its impinging head would adhere sound. Targets are known in which impingement of a projectile having a blunted head produces a decisively audible "ping" or similar sound.

It is a principal aim of the present invention to provide a re-usable, long-life target specially adapted for use with blunted, non-penetrating missiles and projectiles, and having unique and valuable utilities and properties, as set forth herebelow.

A projectile composed of a ballistic material could be used with a "penetrating type" head, which would not penetrate the target web.

SUMMARY OF THE INVENTION

In accordance with the present invention there is provided a target assembly specially configured and constructed to stop the flight a blunted or non-piercing missile or projectile impinging or striking thereagainst.

An important feature of the invention is a high-strength, flexible and resilient web or sheet against which missiles projected against the target impinge.

In a preferred embodiment of the invention, the sheet or web against which the propelled missiles impinge is fabricated of a woven plastics material such as polyamides, polyesters, polyvinyls, polycarbonates, polyurethanes, polyethylenes and propylenes, etc., marketed under such trademarks as Nylon, Lexan, Lucite, Saran, Mylar, Plexiglass, and others. Specially coated or treated natural fibers may also be used.

It is a feature of a preferred embodiment of the invention that the web against which the missiles are directed is supported on a plurality of elements which take the form of resilient and flexible, yet firm and somewhat rigid, rods or bars which are connected or. fastened, at one end of each of said rods, to a circumscribing bounding edge or marginal periphery of the sheet or web at perimetrically-spaced increments about a marginal periphery of the web.

It is a related feature of the invention that the "free" ends of the rods are received and held or supported in a block or hub which is, in turn, supported on a substrate, the hub being at a distance from the web that is less than a length dimension of the web-supporting rods when the latter are straight or fully extended.

In the embodiment of the invention illustrated, the target sheet or web is rectangular and preferably square, and four rods or struts are employed, one being fastened at each corner.

In a preferred embodiment of the invention the rods fastened to the opposed upper corners of the target web are disposed to enter the hub or block in a generally downwardly-directed mode or attitude, and the rods fastened to the opposed lower corners of the target web are disposed to enter the hub or block in a generally upwardly-directed mode or attitude, while the hub or block is supported at a height corresponding generally to a mid vertical height or expanse of the target web.

It is a related feature of the invention that eyelets in the form of grommets are provided at each of the corners of the web, and that short segmental lengths of tubing of rubber or of plastics composition are looped through the web-carried grommets.

In the embodiment of the target illustrated, that end of the support rod which is connected to the web extends into and through a short section of the tubing which is, in turn, looped through the grommet, and the projecting end of the rod is then inserted into the other or free end of the tubing. Preferrably, the end of the rod is covered, capped, or sleeved, or otherwise formed with a sector which is somewhat enlarged diametrically.

In a preferred embodiment of the invention the hub or block to which the ends of the web support rods converge and to which they are secured is carried and supported by a downwardly-extending bar or rigid wand which is, in turn, set in a base which rests on the ground, or other suitable substrate. Optionally, the base may be omitted.

It is an important feature of the present invention is that the base is provided with a pair of laterally-spaced, upwardly-projecting guide struts which are located just laterally outwardly of the respective two lower support rods which extend rearwardly of the target sheet or web. These struts may be inserted directly into the ground.

It is a related feature of the invention that the laterally-positioned struts serve as guide-like limit stops which act to re-orient or to return the lower support rods to their original position or configuration after the target web is struck by a missile or pellet directed thereagainst, the useful effect being to reposition the target web to a stand-by or "ready" orientational configuration, pending the next impact.

In the particular embodiment of the invention illustrated, the substrate-carried base on which the rearwardly-disposed block or hub and, in turn, the rear ends of the arched and resiliently arcuately-deformed web-tensioning rods are carried, comprises a T-shaped structure which includes a laterally-extending length of wood at a center position of which a shorter length of wood is fastened, by dowel connection, or otherwise, all disposed in a horizontal plane, with the shorter wood segment extending rearwardly.

In a preferred embodiment of the invention, the rigid wand and the guide struts are set in tubular holes pre-drilled in the legs of the wooden base.

It is an important and convenient feature of the target assembly of the invention that, when disassembled, the resulting parts or components can be readily and easily packaged to facilitate storage and/or transport.

A related feature of the invention is that the web or target sheet may be easily rolled up to form a compact configuration.

Other and further features, objects and advantages of the invention will be evident from the following detailed description considered in conjunction with the drawings.

BRIEF DESCRIPTION OF THE DRAWINGS

FIG. 1 is front, perspective view of a target assembly in accordance with the present invention, and embodying the features thereof;

FIG. 2 is an exploded view showing the component parts of the target and indicating schematically the manner in which the target of the invention is assembled;

FIGURE is an enlarged detail showing the manner in which a web-supporting rod is fastened to the target sheet or web.

DETAILED DESCRIPTION OF ILLUSTRATED EMBODIMENT

Figure 3:
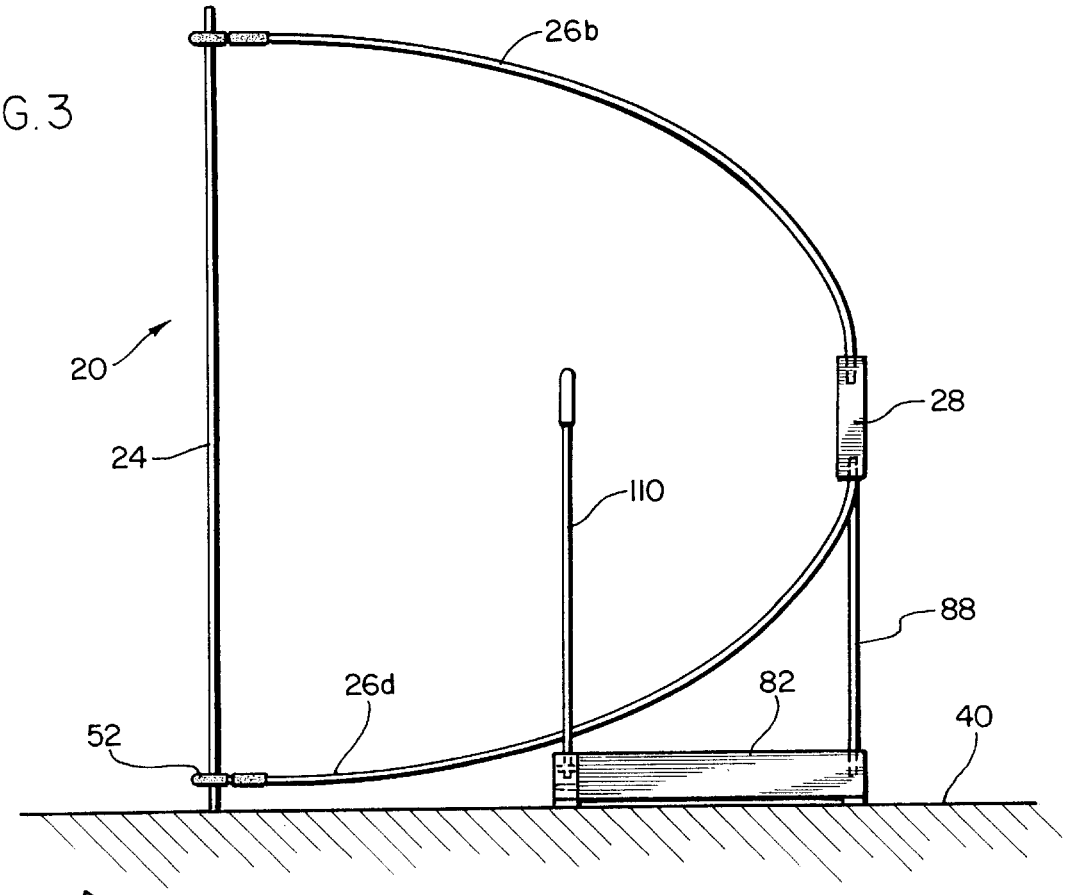
FIG. 3 is a side elevational view of the target assembly of the invention.

The aims and objects, and a realization of its advantages are achieved, in accordance with the present invention, through the engineering and design of a novel and useful target for use with a variety of non-piercing type projectiles or missiles launched or otherwise directed to impinge against a target sheet or web. The target assembly takes the form of a sheet or web formed of an exceedingly strong yet flexible material woven or otherwise textured. The web or sheet of the target is tensioned to assume an expansive or generally planar or flat mode by means of a plurality of arched, spring-like, flexible rods of a fiber glass composition or other suitable material. In a preferred embodiment of the invention, the target web is generally, and the flexible and resilient support rods are attached at each of the corners. The opposite ends of the rods are secured at a rearwardly-displaced hub which is, in turn, supported on a base resting on a substrate. Seated in, to project upwardly of the base is a pair of upwardly projecting guide struts positioned close to but laterally just beyond each respective of the lower web-supporting rods. The struts serve the function of ensuring that, upon being struck by a missile and distorted, the target web will nevertheless promptly recover and will return to its original spatial configuration and orientation.

Referring now to the drawings, and more particularly to FIGS. 1 and 2, for purposes of illustrative disclosure, and not in any limiting sense, a preferred embodiment of the invention is shown as a target assembly 20 the principal components of which include a target sheet 24, a group of flexible, tensioned and resilient rods 26*a*, 26*b*, 26*c* and 26*d*, a hub or block 28, and a supporting frame or base 32, the base 32 and the lower edge 34 of the target web 24 resting on the ground or other suitable substrate 40.

Figure 4:
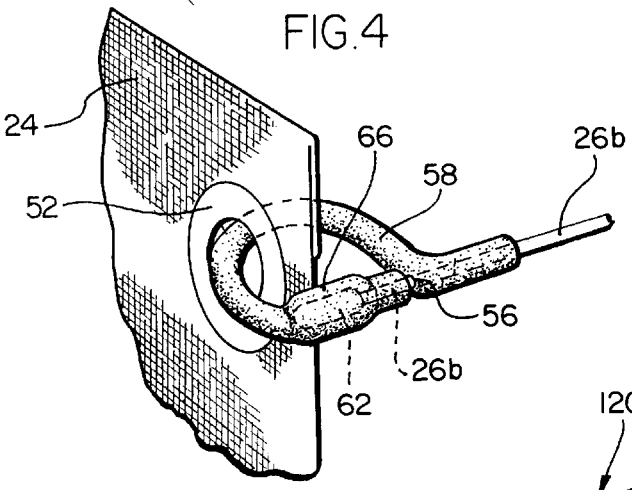
Figure 5:
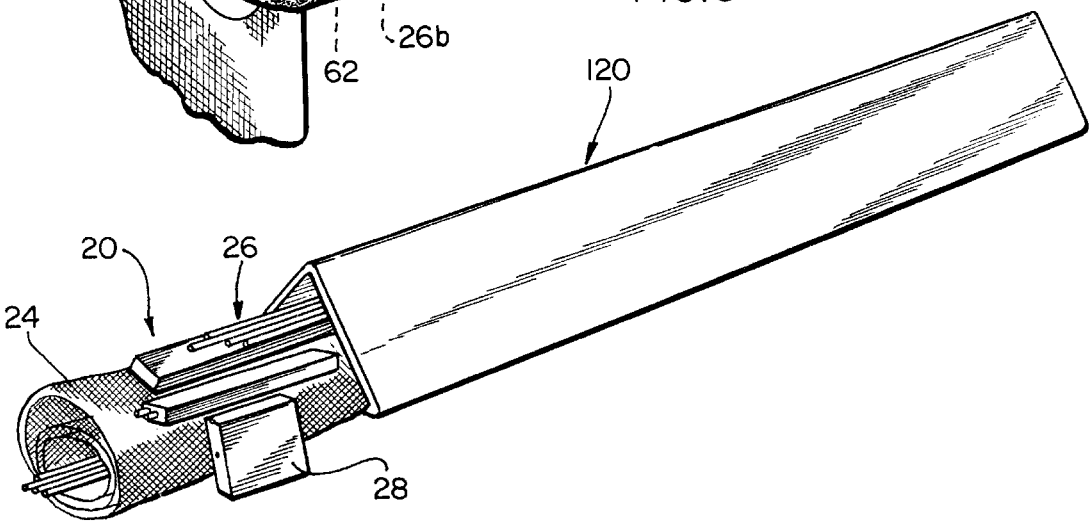
FIG. 5 is a perspective view indicating schematically the manner in which the components of the disassembled target may be packaged for shipment or storage.

One end of each of the rods 26*a* through 26*d* is attached to each of the corners 42, 44, 46 and 48 of the web or target sheet 24. In the particular embodiment of the invention depicted, a grommet 52 is provided at each corner of the web 24. The end of each rod 26*a* through 26*d* extends into and through the wall 56 of a short section of tubing 58 which is in turn looped through the grommet and then fastened over a projecting end 62 of the rod 26*b* (FIG. 4). The end 62 of the rod 26*b* is shown as capped or sleeved 66. As shown in FIGS. 1 and 3, the opposite ends 70*a* through 70*d* of the respective rods 26*a* through 26*d* extend into and are retained in accommodating bores 74 formed in the hub or block 28.

In the embodiment of the invention illustrated, the base 32 is in the form of a T which includes a horizontally-extending member 80 joined to a rearwardly directed leg 82 by means of dowels and cooperating bores 86, or other suitable means or techniques. The hub 28 is supported on a standard 88 located at a rearward end 92 of the leg 82, a lower end 96 of the standard being seated in a cooperating bore 98 in the leg 82, and the hub 28 being impaled on an upper end 102 of the standard 88, a suitable accommodating bore 104 being formed to open downwardly of the hub or block 28.

Alternatively, the lower end of the standard 88 may be forced directly into the ground.

The base 32 supports a pair of laterally-spaced, upwardly-opening bores 114 and 116 formed in the laterally-extending member of the T-shaped base 32. The struts 108 and 110 serve as guide-like limit stops which act to restrain excessive or possibly damaging displacement of the lower rods 26*c* and 26*d* and to orient and return these rods to their original positions and configurations after the target web 24 is struck or impacted by a missile or pellet directed thereagainst. The useful effect is to reposition the target web 24 to a stand-by or "ready" orientational configuration pending the next impact.

The assembly 20, in its dismantled form, may be quickly and conveniently packed in a suitable, relatively small, tubular container 120 for storage or shipment.

Assembly and disassembly, as well as replacement of the target web 24 are facilitated by the provision of "quick-attach" loops 124 which secure the web corners to the rods 26.

What is claimed is:

1. A target for use with a variety of non-piercing projectiles and missiles launched to impinge thereupon, said target comprising, an assembly including high-impact-strength, shock-sustainable, and shock-absorbing flexible web means extending in a vertical plane for effectively terminating the flight of a non-piercing missile impinging against said web means upon release of such a missile directed toward to impact upon said target, a plurality of elongate, bendable, flexible, and resilient rod means for resiliently extending and stretching said web means and for biasing said web means to assume an expansive, generally planar configuration, said rod means each having first and second ends, securement means for connecting said first end of each of said rod means to said flexible web means at circumferentially-spaced, perimetric increments about a circumscribing marginal periphery of said web means, hub means positioned rearwardly of said web means at a distance less than a length dimension of fully extended said rod means for serving as a support for said second ends of each of said rod means remote from said first ends of said rod means, said rod means including a pair of lower rods extending from a lower end zone of said hub means adjacent opposed laterally-spaced extremities thereof to said web means, and wherein said lower rod means are secured and resiliently deformed to define tensioned, arcuate struts, said target further including base means for seating on a substrate on which a lower end of said web means abuts, guide means seated in and extending upwardly exteriorly of said lower rod means for limiting laterally outward displacement of said lower rod means in response to torquing forces generated by impacting of a missile against said web means, said base means being positioned rearwardly of said web means, and wherein said base means is formed with receptacle means for insertion of said guide means therewithin to extend upwardly therefrom.

2. A target as set forth in claim 1 and further comprising means distinct from said rod means for supporting said hub means in an elevated attitude above a lower edge extremity of said web means.

3. A target as set forth in claim 1 and further comprising support means fastened to and projecting downwardly from said hub means at an elevation intermediate lower and upper reaches of said web means.

4. A target as set forth in claim 1 and further comprising strut means extending vertically between said hub means and said frame means for supporting and for stabilizing said hub means at an elevation above the substrate on which said web means depends.

5. A target as set forth in claim 1 and further comprising support means for supporting said hub means above the substrate, and wherein said support means comprises rigid wand means extending between said base and said hub means, and secured in each.

* * * * *